United States Patent [19]

Harper

[11] 3,967,820

[45] July 6, 1976

[54] AMBULATORY ROCKING DEVICE

[76] Inventor: James T. Harper, 824 Beecher, Pittsford, Mich. 49271

[22] Filed: Nov. 24, 1975

[21] Appl. No.: 634,432

[52] U.S. Cl. ..... 272/70; 272/1 R; 272/56; 280/12.1

[51] Int. Cl.[2] ..... A63B 23/04

[58] Field of Search ..... 272/1 R, 1 B, 60 A, 272/60 R, 57 E, 57 J, 57 R, 57 A, 57 B, 56, 33 A, 70, 70.3; 280/12 R, 12 B, 12 C, 12 H, 12.1, 12.11, 12.12; D34/5 R, 5 B, 5 D

[56] References Cited

UNITED STATES PATENTS

| | | | |
|---|---|---|---|
| 246,458 | 8/1881 | Chandler | 272/56 |
| 2,253,996 | 8/1941 | Bechman | 272/60 R X |
| 2,531,946 | 11/1950 | Parker | 280/12 R X |
| 2,714,007 | 7/1955 | Jordan | 272/57 A |
| 2,941,801 | 6/1960 | Pedersen | 272/57 R X |
| 2,950,120 | 8/1960 | Stewart | 272/57 R X |
| 3,188,087 | 6/1965 | Larson, Jr. | 272/1 R X |
| 3,416,792 | 12/1968 | Morgan et al. | 272/60 R |
| 3,451,672 | 6/1969 | Kazdan | 272/56 |
| 3,780,469 | 12/1973 | Hancovsky | 272/56 X |
| D178,996 | 10/1956 | Gordon | D34/5 C |

*Primary Examiner*—Richard C. Pinkham
*Assistant Examiner*—Arnold W. Kramer
*Attorney, Agent, or Firm*—Gerald K. Flagg

[57] ABSTRACT

A shell-like light weight low-cost ambulatory rocking device comprises top and bottom portions, the top portion comprising a centrally located top surface bounded at each of its outboard ends by a depressed foot placement platform and the bottom portion comprising a centrally located arcuate portion bounded at each of its outboard ends by a longitudinally extending downwardly depending rocking motion limiting ridge.

2 Claims, 2 Drawing Figures

AMBULATORY ROCKING DEVICE

The present invention relates to an ambulatory rocking device intended for amusement and exercising purposes and adapted to support the body of a user for rocking movement from side to side while maintaining a position, traveling forwardly or rearwardly, turning, or accomplishing other maneuvers, all by controlled shifting of the user's body weight.

The recognition of the dependence of good health on regular exercise, preferably coupled with mental recreation, has led to increased attention to physical culture and the values of active play for adults and children. Improved health and physical appearance, increased muscle tone, and enhanced gracefulness and coordination are usual results of proper exercise.

Children run and play and engage in sports activity to an extent usually adequate for body development. Particularly for those adults who are engaged in sedentary occupations, however, it is desirable to participate in purposeful exercise unless some form of play exercise appeals to the individual. As a purposeful exercise, calisthenics are frequently performed.

Children and adults frequently utilize various auxiliary devices during periods of exercise in order to relieve the boredom of simply moving the arms and legs about and, in many cases, to concentrate on the development of certain muscles and body parts. Although perhaps unconsciously, when children stand with their feet apart on a board balanced on a rock or other object and cause the board to teeter from side to side, they are in effect exercising their leg muscles and improving their poise, coordination and body balance. Gymnasiums are usually equipped with leg exercising apparatus designed and manufactured to accomplish some of these desirable results. Other devices which are available and are generally classified as toys, such as hula hoops enable the user to exercise and develop various muscles of the body while at the same time deriving considerable pleasure and amusement from the device. The essence of the present invention resides in the provision of a device adapted for both amusement and exercise of children and adults and which enables the user to rock forwardly and rearwardly and from side to side thereby to exercise the legs in particular and to enable the user to achieve improved coordination and balance. In order properly to employ and derive the greatest benefit from the device, a certain degree of proficiency borne of practice is required. Thus the device tests and serves as a challenge to the skill of the user so as to enhance the amusement and pleasure attending its use.

Accordingly, it is an object of the present invention to provide a novel light weight and low cost ambulatory rocking device.

Another object is to provide a rocking device of the foregoing type especially adapted for amusement and exercise.

Another object is to provide a device intended to afford users thereof training in balance and body coordination.

Another object is to provide a device of the type described which is adapted for rocking movement from side to side, forwardly and rearwardly, or combinations of these movements, incident to corresponding shifting of the weight of the body on the device.

Another object is to provide such a device on which a person using the same can walk with a rocking movement.

Another object is to provide a rocker construction which facilitates control of rocking or walking movements.

These, together with other objects, will become more fully apparent upon reference to the following description and accompanying drawing. In the drawing.

Figure 1:
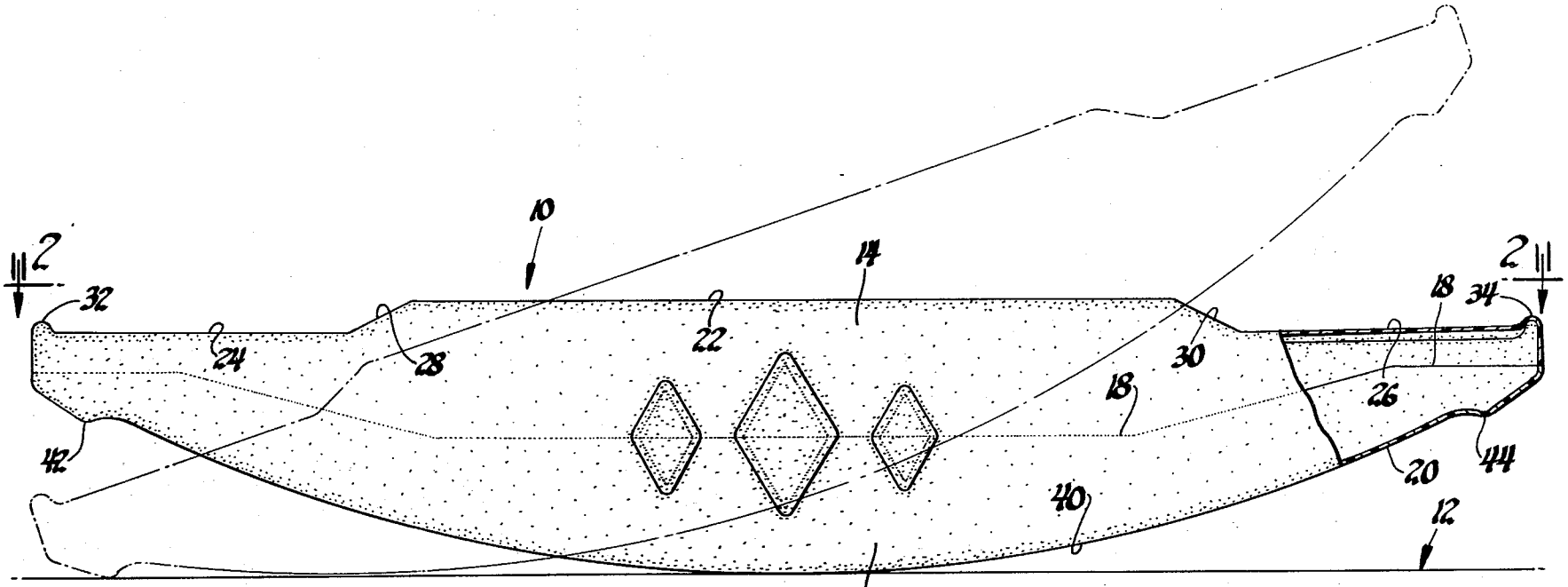
FIG. 1 is a front elevation of a rocking device embodying the principles of the present invention and showing the device in phantom in one operating position.
Figure 2:
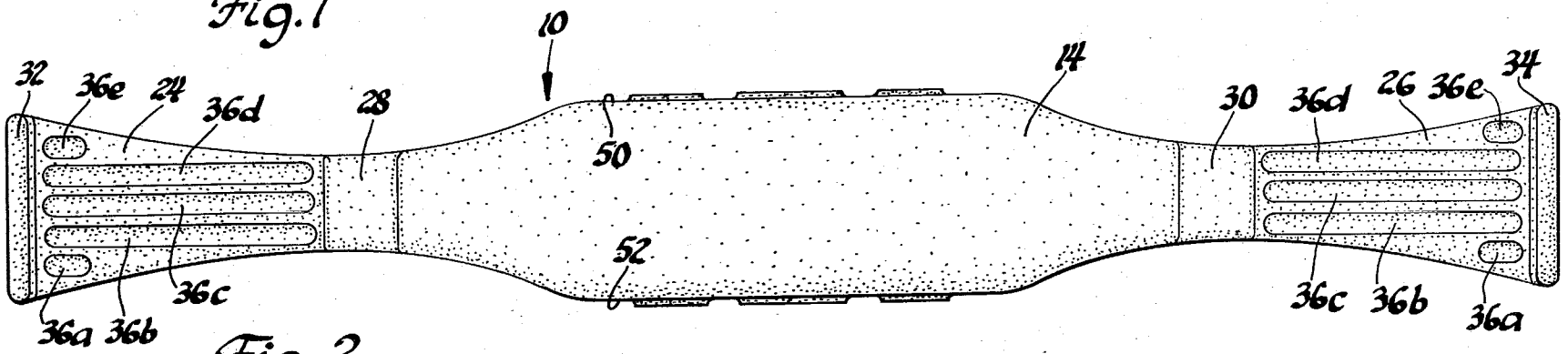
FIG. 2 is a top plan view of the rocking device.

With reference now to FIGS. 1 and 2, there is shown am ambulatory rocking device 10 of the type contemplated by my present invention supported on a stationary surface 12 in the form of a carpet, floor, sidewalk, etc.

The rocking device 10 comprises generally shell-like top and bottom portions 14 and 16 respectively integrally mated to each other along a mating or parting line 18. Mating line 18 might be formed by a pair of molds used for blow molding the rocking device as one integral piece. Both the top and bottom portions comprise thin walls 20 of about 0.095 inches in thickness made of a high density polythelene so that the overall weight of the device is no more than 250 grams.

The top shell-like portion 14 comprises centrally located top surface 22 extending in a transverse direction and bounded at each of its transversely outboard ends by a depressed left or right foot placement platform 24 or 26 when viewed on FIGS. 1 or 2. Each foot placement platform 24 and 26 depressed so as to form a surface parallel to but below central surface 22, and each foot placement platform 24 and 26 is connected its transversely inboard end to central surface 22 by a foot capture up-slope surface 28 or 30 respectively and is bounded at its transversely outboard end by an upstanding foot capture lip 32 or 34. Foot capture lips 32 and 34 cooperate with foot capture up-slope surfaces 28 and 30 when device 10 is titled transversely to provide transverse restraint for a foot or apparel worn thereby urged against surfaces 24 and 26, lip 32 cooperating with slope 30 or lip 34 cooperating with slope 28. Intermediate their respective foot capture lips 32 and 34 and foot capture up-slope surfaces 28 and 30, foot placement platorms 24 and 26 comprise a plurality of transversely extending ridges 36*a*, *b*, *c*, *d*, and *e* for providing additional transverse strength while also providing longitudinal restraint on any foot or worn thereby that is urged against surfaces 24 and 26 while using the device 10.

The bottom shell-like portion 16 comprises a centrally located arcuate surface 40 extending substantially the entire transverse length of top surface 22, 24 and 26 and terminating at each of its transversely outboard ends in a downwardly depending rocking motion stop ridge 42 and 44 extending the longitudinal length of lips 32 and 34. Stop ridges 42 and 44 are operative to cooperate with bottom arcuate surface 40 when tilted on surface 12 to safely limit the transverse motion of device 10 so as to enhance the transverse stability of the user thereof. The width of surface 40 is selected to afford longitudinal stability.

The top and bottom shell-like portions 14 and 16 comprised longitudinally spaced apart front and rear walls 50 and 52 extending the vertical height of device 10 intermediate flat top surface 22 and bottom arcuate surface 40. Spaced intermediate flat top surface 22 and arcuate bottom surface 40 on each of the front and rear walls 50 and 52 are a plurality of vertical support enhancing means spaced apart on the transverse direction and projecting outwardly from front and rear walls 50 and 52 in the longitudinal direction.

The operation of the described embodiment of the subject invention is believed to be readily apparent and is briefly summarized at this point.

The device is supported on the floor or the ground 12 with arcuate surface 40 in ground engagement. In order to use the device for rocking purposes, the user steps on the platform 24 and 26. This does not result in forward and rearward or side to side rocking of the device because the weight is concentrated centrally of the platform. As long as the weight on each foot is uniformly distributed, the horizontal attitude of the device 10 is maintained.

By shifting the weight of the body from one foot to the other, it will be evident that the device 10 can be rocked from side to side. During these movements, the side flanges 32 and 34 prevent the feet from slipping laterally off from the foot platform 24 and 26. The normal or average range of rocking is approximately 30° measured from the neutral horizontal position of the platform to the maximum laterally tilted position on either side. That is, of course, determined by the curvature of the surface 40 and the dimensions of the device as well as the ability of the user. The 30° noted corresponds to the preferred commercial embodiments of the device.

Concurrently with side to side tilting, the device 10 can be tilted forwardly and rearwardly simply by shifting the body forwardly and rearwardly on the platform, as will be evident. Still further, while keeping the legs substantially stiff and by combined action of lateral shifting of body weight and forward movement of opposite sides of the platform, the user can ambulate or walk along on the device. More specifically, the side of the platform on which the weight is relieved is shoved forwardly by the foot of the user so as to pivot the platform. By alternately shifting and pivoting, the described walking can be performed.

From the foregoing it will be evident that a highly amusing device adapted for both pleasure and exercise has been provided. Inasmuch as the device is designed for effecting lateral forward and rearward rocking, it is especially helpful in developing body balance of users thereof. The rocking device is simple and economical to construct and can readily be enjoyed after a certain amount of practice.

Although the invention has been herein shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

Having described my invention, what I claim as new and desire to secure by Letters Patent is:

1. A substantially hollow and light weight bi-ped supporting rocking-and-ambulating recreation device having transverse width substantially in excess of either its vertical height or longitudinal length, said device comprising top and bottom shell-like portions mutually engaging and supporting each other at a single mating lip encircling the periphery of said device, said top and bottom shell-like portions comprising respectively top and bottom transversely extending surfaces and front and back longitudinally spaced apart walls extending vertically from said top and bottom surface, said top surface comprising a substantially flat central portion bounded at each of its outboard ends by a downwardly recessed platform portion for locating and supporting a respective foot of said bi-ped, said bottom surface comprising a substantially arcuate portion bounded at each of its outboard ends by a downwardly extending rocking stop portion, and said front and back walls of said top member defining one side of said mating lip and comprising therealong contiguous first and second top wall portions and said front and back walls of said bottom member defining the other side of said mating lip and comprising therealong contiguous first and second bottom wall portions aligned coplanar respectively with said first and second top wall portions and mated thereto at said mating lip, said first portions of each said top and bottom wall portions being substantially coplanar in a first vertical plane to provide a primary support of said bi-ped in the verticle direction and said second portions of said top and bottom wall portions being coplanar in a second vertical plane different from said first vertical plane for a secondary support of second bi-ped in said verticle direction.

2. The device of claim 1 wherein said transverse width is at least five times either the longitudinal length or vertical height and wherein said device weighs no more than 250 grams while providing a primary support of at least 300 pounds and a secondary support of at least 150 pounds.

* * * * *